US008387794B2

(12) United States Patent
Stitzlein

(10) Patent No.: US 8,387,794 B2
(45) Date of Patent: Mar. 5, 2013

(54) CONTAINER TO HOLD GIFTS

(76) Inventor: Marc Stitzlein, St. Louis, MO (US)

( * ) Notice: Subject to any disclaimer, the term of this patent is extended or adjusted under 35 U.S.C. 154(b) by 62 days.

(21) Appl. No.: 12/985,152

(22) Filed: Jan. 5, 2011

(65) Prior Publication Data

US 2011/0162990 A1 Jul. 7, 2011

Related U.S. Application Data

(60) Provisional application No. 61/292,686, filed on Jan. 6, 2010.

(51) Int. Cl.
*B65D 85/00* (2006.01)

(52) U.S. Cl. ..... 206/427; 206/459.5; 220/509

(58) Field of Classification Search ..... 40/312; 206/457, 459.1, 459.5, 427, 429; 220/509, 220/510, 512, 513, 515
See application file for complete search history.

(56) References Cited

U.S. PATENT DOCUMENTS 1,648,648 A * 11/1927 Lilleston ..... 206/0.81
4,062,445 A * 12/1977 Moe ..... 206/1.5
4,603,787 A * 8/1986 Essary ..... 220/1.5
4,613,041 A * 9/1986 Carlton ..... 206/373
4,742,911 A * 5/1988 Manuel ..... 206/425
5,240,113 A * 8/1993 Gibilisco ..... 206/534
5,267,650 A * 12/1993 Gilbilisco ..... 206/534
5,725,382 A * 3/1998 Walter et al. ..... 434/258
6,123,187 A * 9/2000 Bartels ..... 206/0.6
6,173,837 B1 * 1/2001 Marconi ..... 206/457
6,595,381 B1 * 7/2003 Johnson ..... 220/345.1
7,789,242 B2 * 9/2010 Shuai et al. ..... 206/719
2001/0035416 A1 * 11/2001 Dodson ..... 220/524

* cited by examiner

*Primary Examiner* — Jacob K Ackun
(74) *Attorney, Agent, or Firm* — Polsinelli Shughart PC

(57) ABSTRACT

A container to hold gifts or beverage bottles is described. The container provides a unique and customizable gift for a recipient of the container. The container includes two or more compartments. The compartments are configured to hold gifts or a beverage bottle. Two or more panels removably engage to the container to close the compartments. The panels include a first side and a second side. The first side of at least one of the panels includes a first message and the second side of the at least one panel includes a second message. The first message is visible when the panel is engaged to the container, and the second message is concealed when the panel is engaged to the container.

21 Claims, 10 Drawing Sheets

CONTAINER TO HOLD GIFTS

CROSS REFERENCE TO RELATED APPLICATION

This application claim priority to U.S. Provisional Patent Application No. 61/292,686 filed Jan. 6, 2010.

FIELD OF THE INVENTION

The present invention relates to a container to hold gifts, beverage bottles, and other items.

SUMMARY OF THE INVENTION

A container to hold gifts, beverage bottles, and other items is described. The container comprises one or more compartments. The compartments are configured to hold gifts, beverage bottles, and other items. The container provides a unique and customizable gift for a recipient of the container.

In one aspect, the container holds one or more wine or spirits bottles in its one or more compartments. One or more panels removably engage to the container to close the one or more compartments. The panels comprise a first side and a second side, wherein the first side of at least one of the panels includes a first message, and the second side of the at least one panel includes a second message, wherein the first message is visible when the panel is engaged to the container, and wherein the second message is concealed when the panel is engaged to the container.

The first message may include an instructional message that is visible from an exterior of the container. The second message may include a customized or personalized message, such as a greeting, a personal note, or other text to commemorate a special occasion. For example, each of the plurality of panels includes an instructional message identifying a date to remove the particular panel having the instructional message. For example, a first panel may state on its exterior surface to "Open on Your Honeymoon" while a second panel may state on its exterior surface to "Open on Your 1 Year Anniversary" while a third panel may state on its exterior surface to "Open on Your 5 Year Anniversary." Each of the panels are removed to reveal the concealed second message on the interior of the panel.

For example, the first panel may state on its interior surface to "Have a great time in Hawaii, Love Mom and Dad" while the second panel may state on its interior surface "Best wishes for many more happy years together, Love Mom and Dad" while a third panel may state on its interior surface to "When can we expect grandchildren? Love Mom and Dad."

In other aspects, the container holds a plurality of beverage bottles. The container includes a plurality of compartments, wherein the compartments are configured to hold beverage bottles. A plurality of panels removably engage to the container to close the compartments. The panels comprise a first side and a second side, wherein the first side of at least one of the panels includes a first message and the second side of the at least one panel includes a second message, wherein the first message is visible when the panel is engaged to the container, and wherein the second message is concealed when the panel is engaged to the container.

In other aspects, the container may be customized for birthdays or other special events. For example, a first panel may state on its exterior surface to "Open on Your 21$^{st}$ Birthday" while a second panel may state on its exterior surface to "Open on Your 30$^{th}$ Birthday" while a third panel may state on its exterior surface to "Open on Your 40$^{th}$ Birthday." Each of the panels are removed to reveal a concealed second message on the interior surface of the respective panel. For example, the first panel may state on its interior surface "Hope it was the best!" while the second panel may state on its interior surface "Turning 30 is no big deal" while the third panel may state on its interior surface "Welcome to the second half of your life."

In other aspects, the container may be customized for seasons of the year and the compartments contain a suitable beverage for the specific time of year. For example, a first panel may state on its exterior surface to "Open on the first day of Spring" while a second panel may state on its exterior surface to "Open on the first day of Summer" while a third panel may state on its exterior surface to "Open on the first day of Autumn" while a fourth panel may state on its exterior surface to "Open on the first day of Winter." Each of the panels are removed to reveal a concealed message on the interior of the panel customized for a recipient of the container. The concealed message could be a fond memory for each of the four seasons. The concealed message could be an activity to engage in related to the particular season. The concealed message could also include a recipe for a food item that complements the beverage.

The container may hold a variety of wines, champagnes, spirits, or combinations thereof that are selected by a purchaser for inclusion in the container. The purchaser may choose bottles based on the tastes and preferences of the recipient of the container. For example, a selection of different wines may be included in the container, or a selection of different scotches may be included in the container.

After removal of the panel and withdrawal of the beverage container, the panel may be returned to engagement with the container to display the second message. The container provides a decorative or ornamental piece to a living area, bar, kitchen, dining room, etc.

In other aspects, a container configured to hold beverage bottles is provided. The container comprises: a bottom wall joining a first side wall, a second side wall, a front wall, and a rear wall to form a container. The container further comprising: one or more divider walls extending from the front wall to the rear wall to divide the container into two or more compartments, wherein the compartments are configured to hold a beverage bottle; two or more panels, wherein the panels slideably engage with the container to close the compartments; and wherein the panels comprise a first side and a second side, wherein the first side includes a first message and the second side includes a second message, wherein the second message is concealed when the panel is slideably engaged to the container.

In other aspects, the container may form a "party in a box" suitable for a gift at a bachelor/bachelorette party, retirement party, birthday, or any event. For example, the container may hold a bottle of spirits in a first compartment, shot glasses in a second compartment, and a t-shirt in a third compartment.

In other aspects, a method of providing a customized gift or beverage container is provided. The method includes receiving order information from a purchaser for a customized gift or beverage container, and the order information comprises message information and gift/beverage selection information. The method further includes providing a container to hold gifts or beverage bottles, the container comprising: one or more compartments, wherein the one or more compartments are configured to hold to a gift or beverage bottle; one or more panels, wherein the one or more panels removably engage to the container to close the one or more compartments; and wherein the one or more panels comprise a first side and a second side. The method further includes customizing the first side of at least one of the one or more panels to include a first message and the second side of the one or more panels to includes a second message based on the message information, wherein the first message is visible when the panel is engaged to the container, and wherein the second message is concealed when the one or more panels are engaged to the container. The method further includes placing gifts or beverage bottles in the container based on the gift/beverage selection and engaging the one or more panels to the container.

The method may further comprise customizing the least one panel with the first message that is an instructional message identifying a date to remove the at least one panel and customizing the at least one panel with the second message that is a personalized message.

The method may further comprise customizing a first side of a first panel with an instructional message identifying a first date to remove the first panel, further comprising customizing a first side of a second panel with a second instructional message identifying a second date to remove the second panel, wherein the first and second dates are calculated by referring to the recipient's wedding anniversary date, birthday date, retirement date, graduation date, holiday date, or other date defined for a recipient of the container.

The method may further comprise providing order information that contains a number of compartments for the container, a style of the container, an identification of specific bottles of wine or spirits to be placed in the container, a mailing address of a recipient of the container, text for the first and second messages, delivery information, or decorative information for ant exterior of the container.

In other aspects, a container to hold beverage bottles is provided. The container comprises one or more compartments, wherein the one or more compartments are configured to hold a beverage bottle; one or more panels, wherein the one or more panels removably engage to the container to close the one or more compartments; and wherein the one or more panels comprise a first side and a second side, wherein the first side of the one or more panels includes a first message and the second side of the at least one panel includes a second message, wherein the first message is visible when the panel is engaged to the container, and wherein the second message is concealed when the one or more panels are engaged to the container. One of the one or more compartments may be configured to hold a plurality of beverage bottles.

DETAILED DESCRIPTION OF EMBODIMENTS

Figure 2:
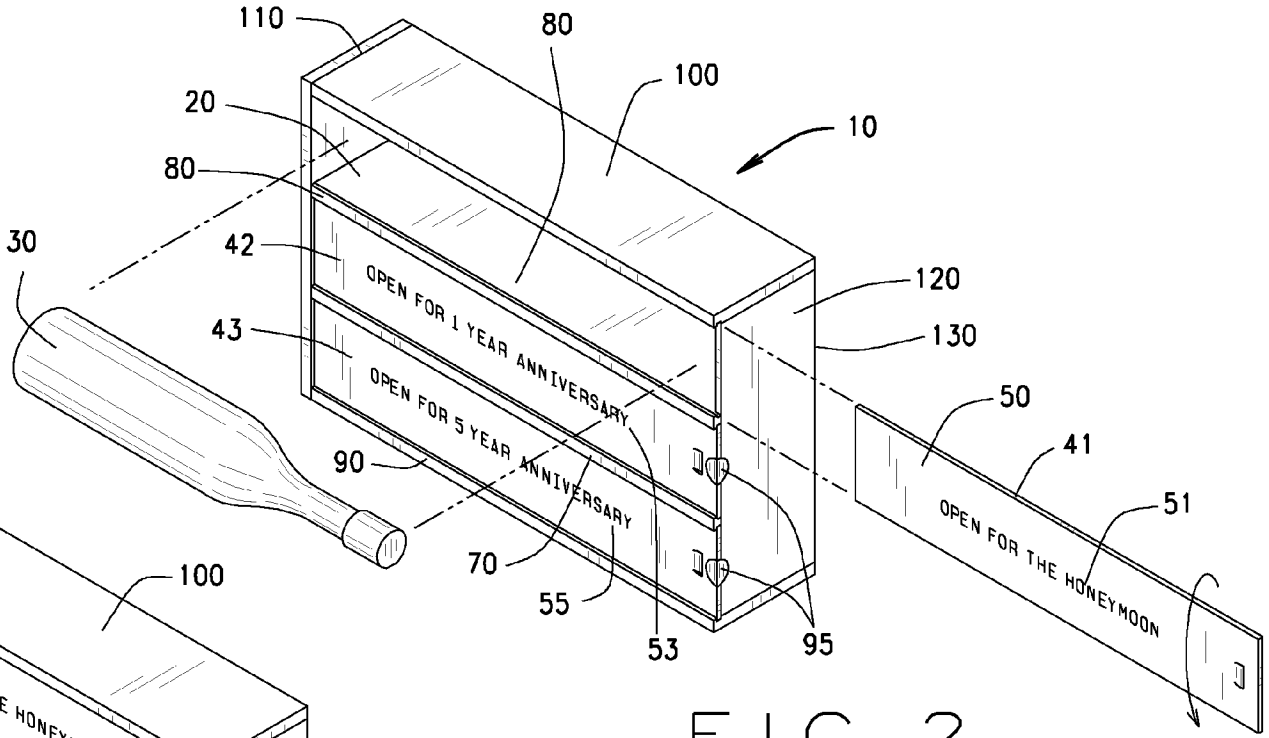
FIG. 2 shows a perspective view of the first embodiment of the container with a panel removed.
Figure 1:
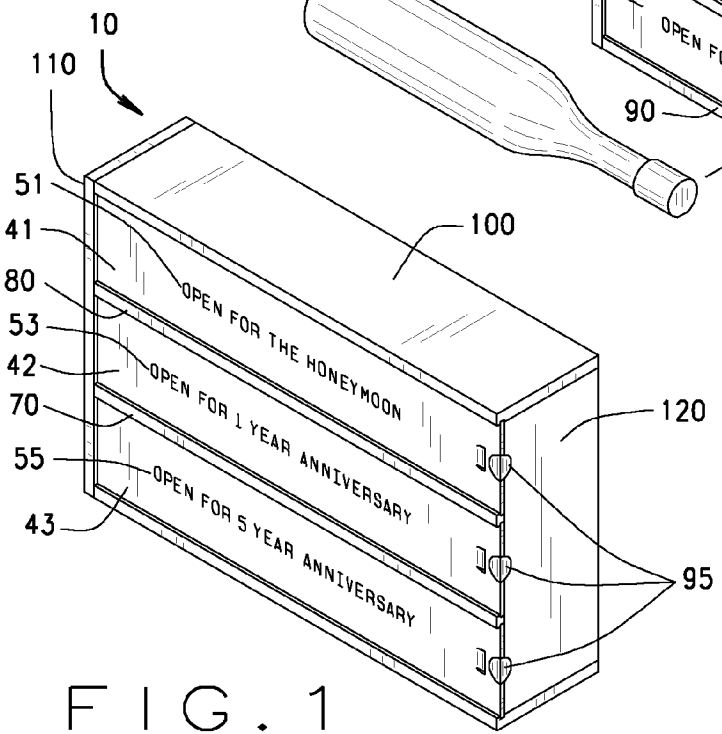
FIG. 1 shows a perspective view of the first embodiment of the container.
Figure 3:
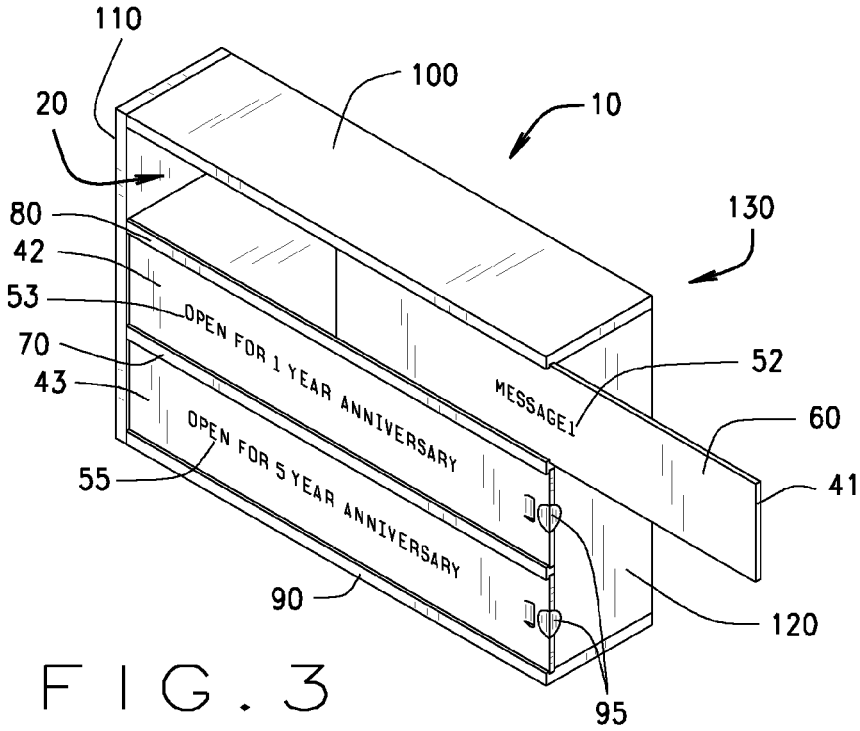
FIG. 3 shows a perspective of the first embodiment of the container with the panel partially removed.
Figure 4:
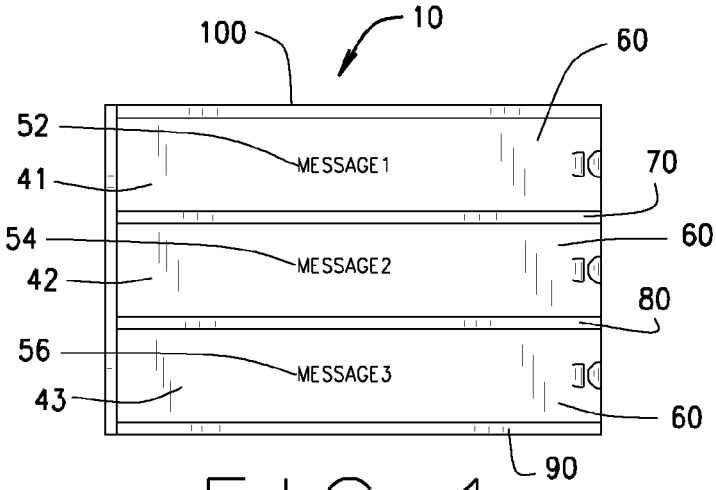
FIG. 4 shows a top view of the first embodiment of the container.
Figure 5:
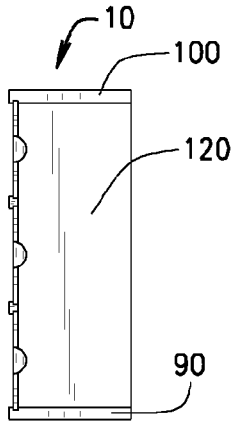
FIG. 5 shows a side view of the first embodiment of the container.
Figure 6:
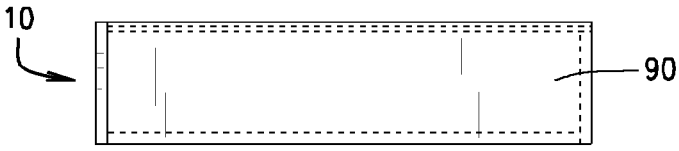
FIG. 6 shows a front view of the first embodiment of the container.

A container will now be described with reference to the FIGS. A first embodiment of the container is shown as container 10 in FIGS. 1-8. The container 10 may hold three beverage bottles 30 in its three compartments 20 or a variety gifts, accessories, and other items. The container 10 may hold one or more beverage bottles 30 in its compartments 20 and any of a variety of accessories in one or more of its compartments 20. The accessories may include, for example, wine glasses, wine charms, snifters, shot glasses, corkscrews, bottle openers, playing cards, t-shirts, etc.

The container 10 includes a bottom wall 130 joining a first side wall 110, a second side wall 120, a front wall 90, and a rear wall 100. A first panel 41, a second panel 42, and a third panel 43 removably engage to the container 10 to close the compartments 20. The panels 41-43 generally have a shape and a size to close the compartments 20 and conceal the contents of the compartments 20. The compartments 20 define a volume to receive the bottles 30. In the embodiment shown, each of the compartments 20 individually holds a bottle 30. However, one or more of the compartments 20 may be scaled up in size to hold a plurality of the bottles 30 in a single compartment 20.

The first panel 41 comprises a first side 50 and a second side 60, wherein the first side 50 includes a first message 51 and the second side 60 includes a second message 52. The second message 52 is concealed when the first panel 41 is engaged to the container 100. The second panel 42 comprise a first side 50 and a second side 60, wherein the first side 50 includes a third message 53 and the second side 60 includes a fourth message 54. The fourth message 54 is concealed when the second panel 42 is engaged to the container 10. The third panel 43 comprises a first side 50 and a second side 60, wherein the first side 50 includes a fifth message 55 and the second side 60 includes a sixth message 56. The sixth message 56 is concealed when the third panel 43 is engaged to the container 10.

The messages described herein may be engraved, burned, printed, painted, drawn, lasered, or otherwise made onto or into the panels 41-43. The messages may also printed on stickers, foils, adhesive sheets, transfer media, substrates, etc. and then positioned on or adhered to the panels 41-43.

The container 10 and the panels 41-43 are made from any of a variety of durable materials capable of supporting the weight of the contents of the container 10. For example, wood, metal, glass, Plexiglas, plastics, composites, plywood, stone, leather, fabric, and combinations thereof may be used in the constructions of the container 10. Preferably, the materials for the container 10 and the panels 41-43 are opaque or non-transparent such that the contents of the compartments 20 and the messages on the second sides 60 of the panels 41-43 remain hidden. The container 10 and the panels 41-43 may be made from different materials. For example, the container 10 may be made from wood, while the panels 41-43 may be made from plywood or other composites.

The exterior surfaces of the container 10 may be decorated or adorned with decorative or ornamental features, photographs, and/or text. For example, if the container 10 is intended as a wedding present, then the exterior surface of the container 10 may include an engraved, lasered, or printed copy of the wedding invitation, a family crest, a family tree, wedding photographs, etc.

The container 10 is generally dimensioned to hold several bottles 30 of beverages, gifts, and/or accessories. The container 10 may be filled with bottles 30, a combination of bottles 30 and gifts/accessories, or all gifts/accessories. The container 10 has a height of approximately 3 to approximately 30 inches. Certain embodiments of the container 10 have a height of approximately 10 to approximately 14 inches. The container 10 has a width of approximately 4 to approximately 24 inches. The container 10 has a depth of approximately 3 to approximately 10 inches. Certain embodiments of the container 10 have a depth of depth of approximately 3 to approximately 5 inches.

Divider walls divide the container 10 into the compartments 20. The compartments 20 generally have a rectangular shape. The compartments 20 are generally configured with a shape to hold the beverage bottle 30. In FIGS. 1-9, a first divider wall 70 and a second divider wall 80 divide the container 10 into three of the compartments 20. As described below, other embodiments use additional divider walls 85 to divide the container 10 into additional compartments 20. As described below, grooves in the walls of the container 10 and grooves in the divider walls 80 and 90 removably receive the panels 41-43.

Figure 8:
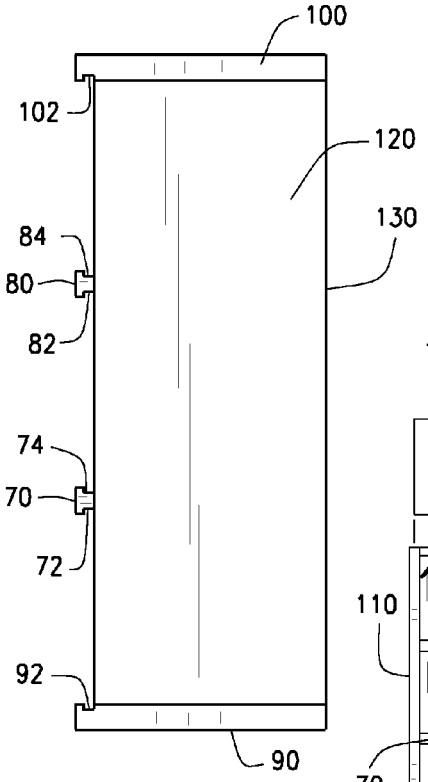
FIG. 8 shows the side view of the first embodiment of the container with all of the panels removed.

With reference to FIG. 8, the first divider wall 70 includes a first divider wall groove 72 and a second divider wall groove 74, while the second divider wall 80 includes a first divider wall groove 82 and a second divider wall groove 84.

The front wall 90 includes a front wall groove 92. The rear wall 100 includes a rear wall groove 102. The first panel 41 slideably engages to the front wall groove 92 and the first divider wall groove 72 of the first divider wall 70. Specifically, opposing edges of the first panel 41 are received in the front wall groove 92 and the first divider wall groove 72. The second panel 42 slideably engages the second divider wall groove 74 of the first divider wall 70 and the first divider wall groove 82 of the second divider wall 80. Specifically, opposing edges of the second panel 42 are received in the second divider wall groove 74 and the first divider wall groove 82. The third panel 43 slideably engages the second divider wall groove 84 of the second divider wall 80 and the rear wall groove 102. Specifically, opposing edges of the third panel 43 are received in the second divider wall groove 84 and the rear wall groove 102.

The panels 41-43 are configured to removably engage to the container 10 such that each panel 41-43 closes one compartment 20 of the plurality of compartments 20. The closing of the compartment 20 conceals the contents of the compartment 20. Further, the removal of one of the panels 41-43 from a first compartment 20 of the plurality of compartments 20 does not reveal the contents of the other compartments 20.

The panels 41-43 generally have a rectangular shape. The panels 41-43 are much thinner in depth as a compared to the container 10. The panels 41-43 provide a removable lid or door for the container 10. Preferably, the panels 41-43 are opaque or non-transparent in order to maintain the contents of the compartment 20 in secret until the panels 41-43 are removed. The panels 41-43 generally have a flat shape, such that the opposing edges of the panels 41-43 removably engage to the container 10.

The panels 41-43 removably engage to the container 10 to close the compartments 20, to conceal contents of the compartment 20, and to hold the beverage bottles 30 in the compartment 20. The compartments 20 may hold different bottles 30 of wine, champagne, or spirits. For example, a bottle of champagne, a bottle of white wine, and a bottle of red wine may be included in the compartments 20. The selection may be customized or selected by a purchaser for the specific tastes or preferences of the recipient. For example, different bottles of red wine may be included in the compartments. For example, different grades or types of whiskey or scotch may be included in the compartments 20.

The container 10 may be divided into any number of compartments 20 by inclusion of the divider walls 70, 80, and 85. The one or more divider walls 70, 80, and 85 divide the container 10 into the plurality of compartments 20. For example, the container 10 may comprise one to nine of the divider walls separating the container 10 into two to ten compartments 20. Each of the two to ten compartments 20 preferably has a corresponding panel. As, such a container 10 with two to ten compartments will generally have two to ten panels.

The container 10 is customized or personalized for a recipient. The first side 50 of the panel 41 and the second side 60 of the panel 41 include different messages. The first message 51 of the panel 41 is an instructional message identifying a date to remove the panel 41. The second message 52 of the panel 41 is a personal message, such as a greeting, advice, wish, thoughts, etc. The first side 50 of the second panel 42 and the second side 60 of the second panel 42 also include different messages. The first side 50 of a second panel 42 of the plurality of panels comprises the second instructional message 53 identifying another date to remove the second panel 42. The second side 60 of the second panel 42 comprises the second personalized message 54.

The dates for the instructional messages 51 and 53 may be selected by the purchaser. The dates may be calculated by referring to the recipient's wedding anniversary date, birthday date, retirement date, graduation date, holiday date, or other date defined for the recipient.

After the bottles 30 are placed in the compartments 20, the panels 41-43 are closed over the compartments 20. The panels 41-43 may be sealed by a sealer 95. The sealer 95 may includes a sticker, wax, adhesive or combinations thereof. The sealer 95 may optionally contain a message, such as repeating the date to open the particular compartment 20. The sealer 95 may contain decorative or ornamental features.

After the panels 41-43 are removed to reveal the contents of the compartment 20, the panels 41-43 may be re-engaged the container 10 to display the second sides 60 of the panels 41-43. As such, the panels 41-43 reversibly and removably engages the container 10.

Figure 9:
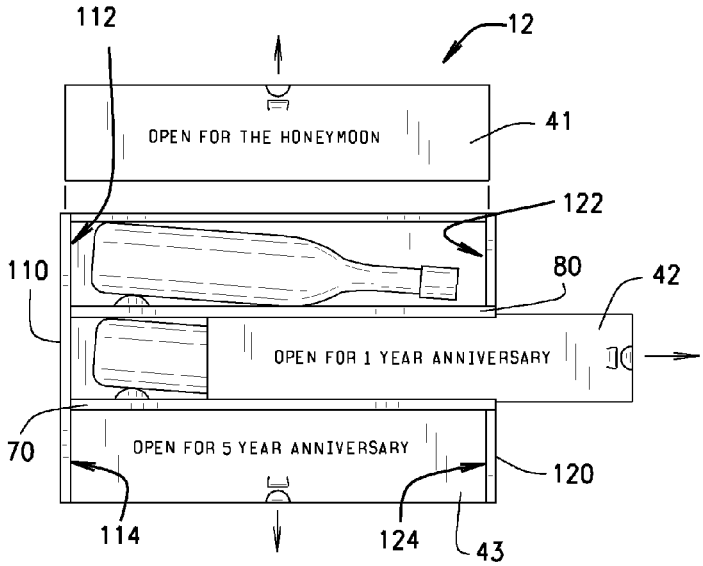
FIG. 9 shows a second embodiment of the container, wherein two of the panels move to the front and back of the container.
Figure 10:
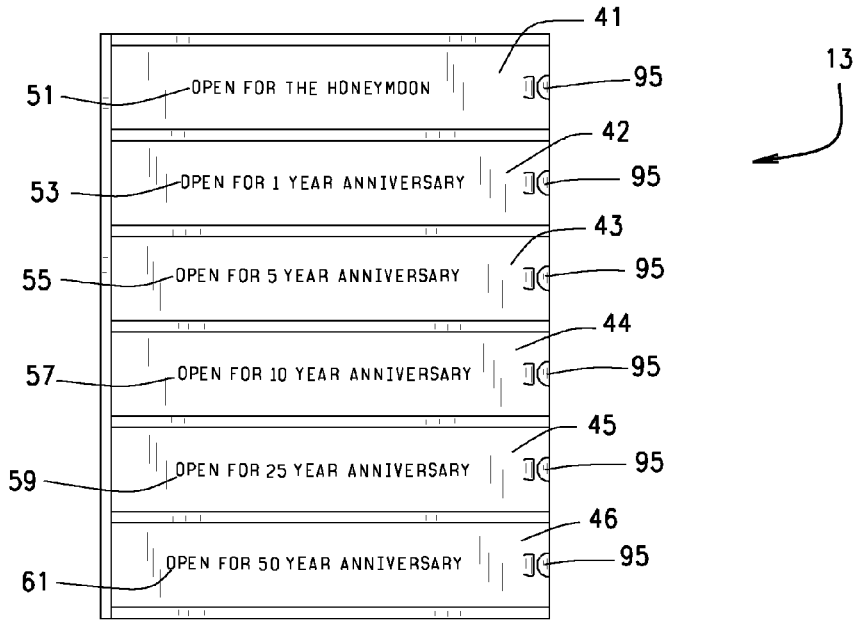
FIG. 10 shows a third embodiment of the container with six compartments.
Figure 11:
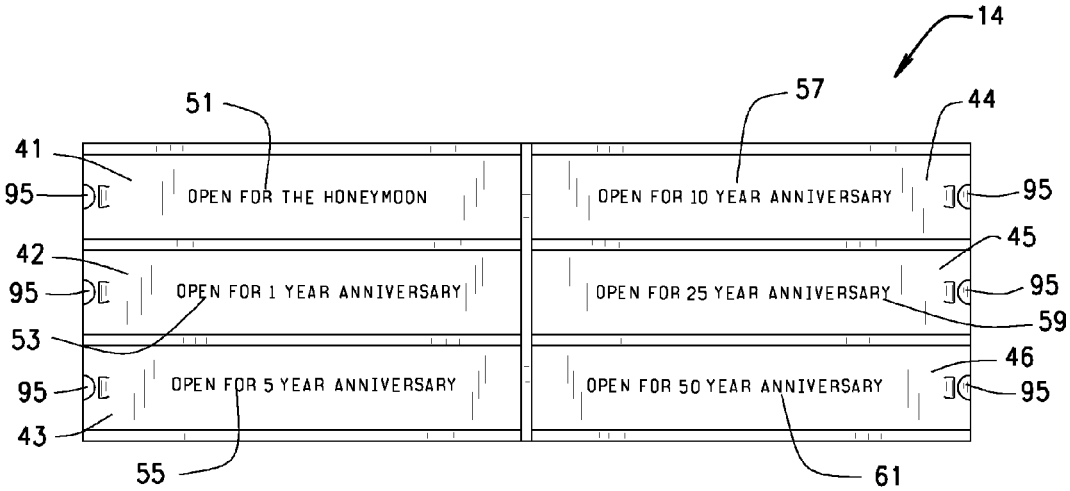
FIG. 11 shows a fourth embodiment of the container with six compartments arranged in side by side fashion.
Figure 12:
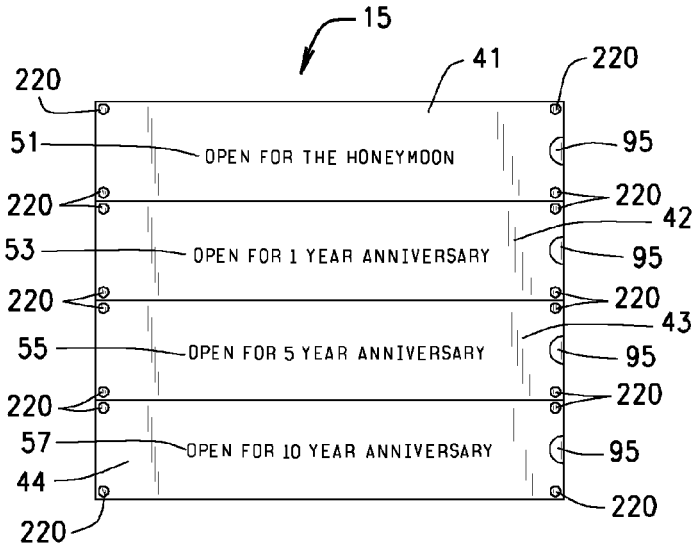
FIG. 12 shows a top view of a fifth embodiment of the container with panels that are screwed to the container.
Figure 13:
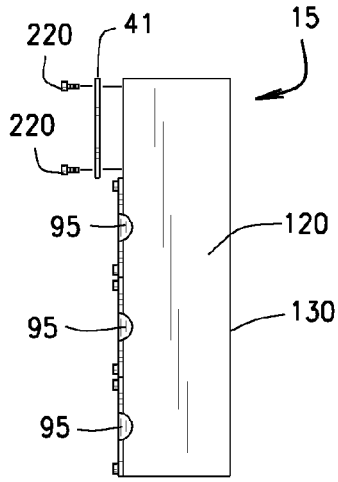
FIG. 13 shows a side view of the fifth embodiment of the container.
Figure 14:
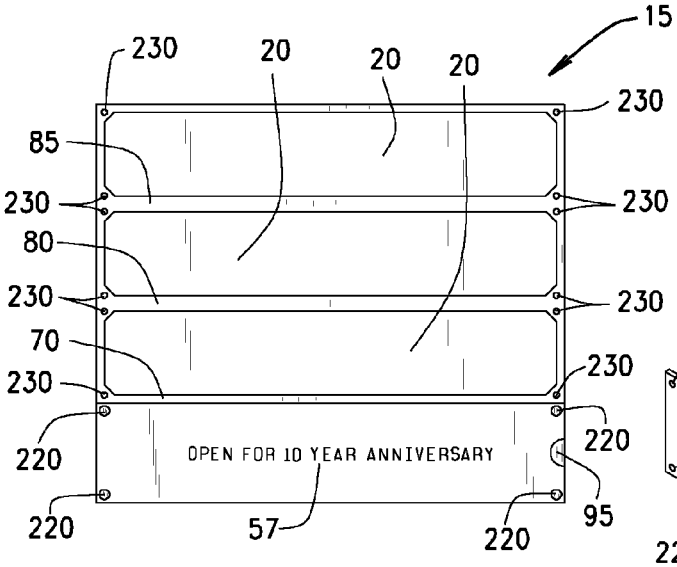
FIG. 14 shows a top view of the fifth embodiment of the container with some of the panels removed from the container.
Figure 15:
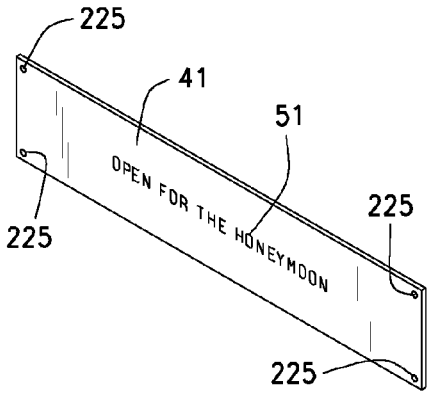
FIG. 15 shows a panel of the fifth embodiment of the container.
Figure 16:
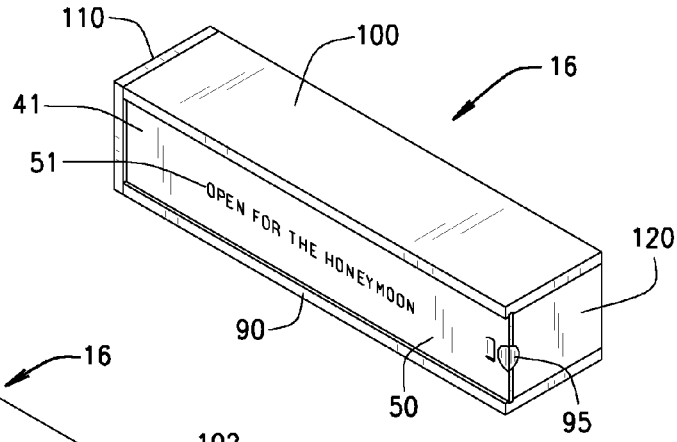
FIG. 16 shows a perspective view of the sixth embodiment of the container.
Figure 17:
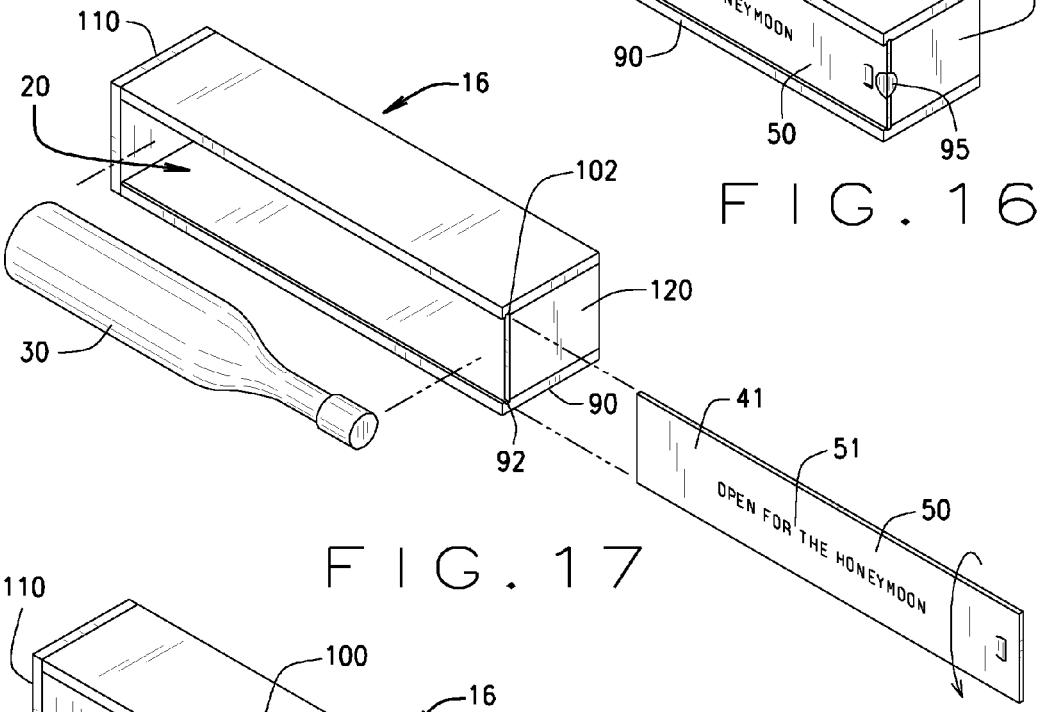
FIG. 17 shows a perspective view of the sixth embodiment of the container with the panel removed.
Figure 18:
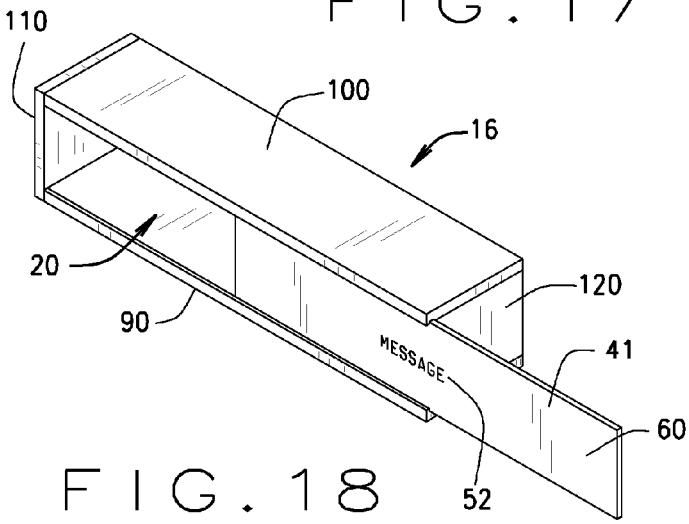
FIG. 18 shows a perspective view of the sixth embodiment of the container with the panel partially removed.
Figure 19:
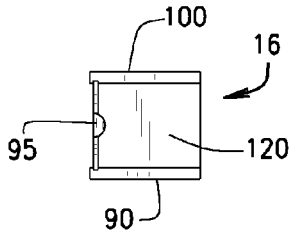
FIG. 19 shows an end view of the sixth embodiment of the container.

The compartments 20 of the container 10 may be arranged in different manners. For example, FIGS. 1-8 show the container 10 with three compartments 20. FIG. 9 shows a second embodiment of a container 12, where two of the panels 41-43 move to the front and rear of the container 10. FIG. 10 shows a third embodiment of a container 13 with six compartments 20 and six panels 41-46. Messages 51, 53, 55, 57, 59, and 61 are on the first sides 50, respectively, of the six panels 41-46. As with the other embodiments, personalized messages are on the reverse sides of the panels 41-46. FIG. 11 shows a fourth embodiment of a container 14 with six compartments 20 arranged in side by side fashion and the six panels 41-46. FIGS. 12-15 show a fifth embodiment of a container 15 with four compartments 20. FIGS. 16-19 show a sixth embodiment of a container 16 with a single compartment 20.

FIG. 9 shows the second embodiment of the container 12, where two of the panels 41-43 move toward the front wall 90 and the rear wall 100. The panel 41 slides in grooves 112 and 122. The groove 112 is in the first sidewall 110, while the groove 122 is in the second sidewall 120. The panel 43 slides in grooves 114 and 124. The groove 114 is in the first sidewall 110, while the groove 124 is in the second sidewall 120. As such, the panels 41 and 43 move in opposite directions.

FIGS. 12-15 show the container 15 with panels 41-44 that are screwed to the container 15. The panels 41-44 are movable and replaceable like the sliding version of FIGS. 1-11. Fasteners 220 hold the panels 41-44 to the container 15. In this embodiment, the panels 41-44 are provided with holes 225 that receive the fasteners 220. The fasteners 220 thread into or engage the container 15 to hold the panels 41-44 in the closed position. The fasteners 220 may thread into or engage holes 230 of the first sidewall 110, the second side wall 120, the front wall 90, the rear wall 90, the divider walls 70, 80, 85 or combinations thereof in order to close the container 15. The fasteners 220 may include screws, wing nuts, screws with decorative heads, cam locks, etc.

Figure 7:
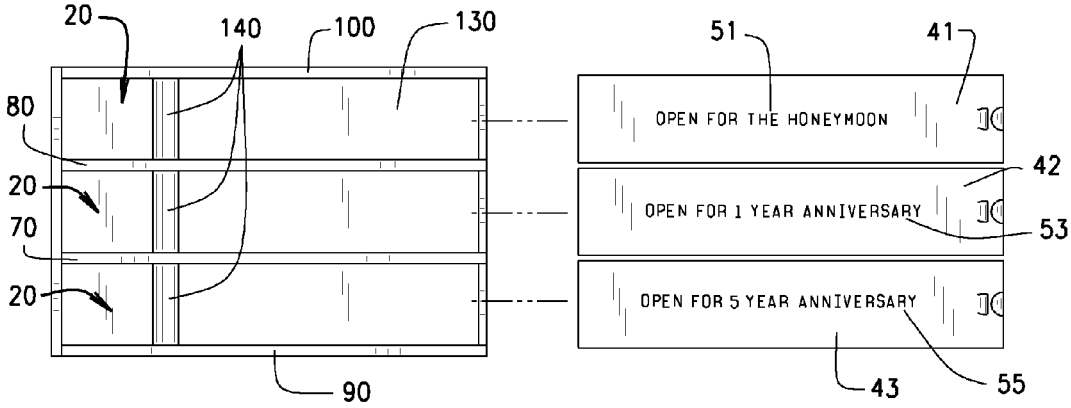
FIG. 7 shows a top view of the first embodiment of the container with all panels removed.

FIG. 7 shows optional bottle supports 140 to keep the cork wet when the container is positioned horizontally. FIG. 9 also shows optional bottle supports 140 to keep the cork wet when the container is positioned vertically. The bottle supports 140 comprise padding or other material that supports the bottle 30 in order the keep the cork wet. The bottle supports 140 may attach to the bottom wall or divider wall, depending upon the orientation of the container 10.

FIGS. 16-19 show the container 16 with a single compartment 20. The single panel 41 removably engages to the container 16 to close the compartment 20. The single panel 41 engages to the front wall groove 92 and to the rear wall groove 102 to close and conceal the contents of the compartment 20. As with other embodiments, the panel 41 comprises the first side 50 and the second side 60, wherein the first side 50 includes the first message 51 and the second side 60 includes the second message 52. The single compartment 20 may contain a single bottle 30, or the container 16 may be scaled up in size to hold a plurality of bottles 30 in a larger single compartment 20.

Methods of ordering and customizing the containers described herein will now be described. The methods will be described with respect to the container 10 of FIGS. 1-8; however, the methods may be used with all of the containers described herein.

Figure 20:
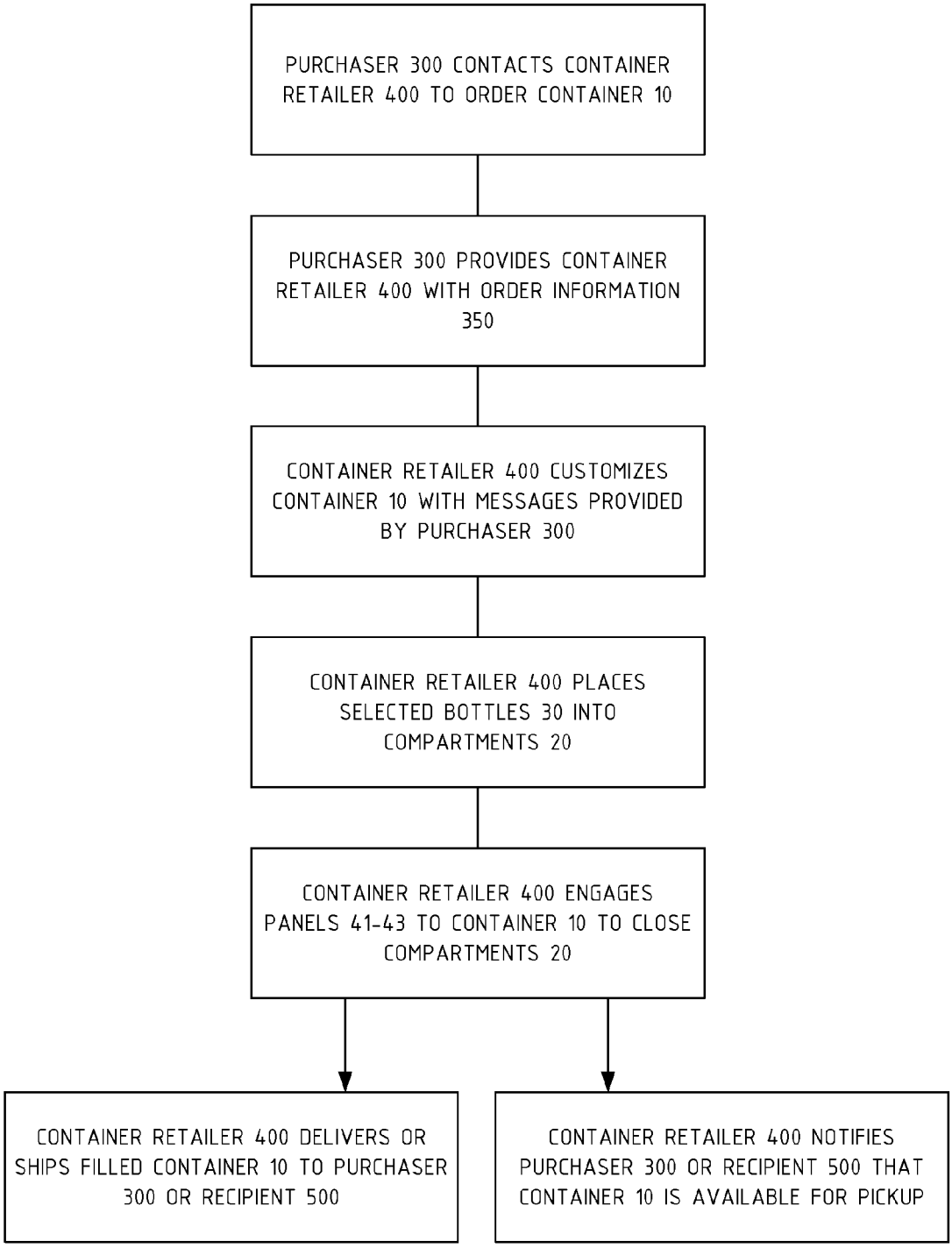
FIG. 20 shows a first method of providing the container to a purchaser or a recipient.

FIG. 20 show a first method of providing the container 10 to a purchaser or a recipient. A purchaser 300 contacts a container retailer 400 to order a customized container 10. The purchaser 300 provides the container retailer 400 with order information 350 including, for example, the number of compartments 20 for the container 10, the style of the container 10, the specific bottles of wine, spirits, gifts, and/or accessories to be placed in the container 10, a mailing address of a recipient 500 of the container 10 (if the container 10 is to be mailed or delivered), text for the messages for the first 50 and second sides 60 of the panels 41-43, delivery information, decorative information for the exterior of the container 10, etc.

The purchaser 300 may also choose from pre-prepared messages in a database or a catalog of messages maintained by the container retailer 400. The purchaser 300 may also select from different packages of wine, spirits, gifts, and/or accessories at different price points. The instructional messages on the first sides 50 of the panels 41-43 may also be defined by the purchaser 300 in any time interval or by other dates specified by the purchaser 300.

The purchaser 300 may log into a website operated by the container retailer 400 and enter the order information 350 into the website of the container retailer 400. The purchaser may select the instructional messages and the personal messages from menus. The purchaser 300 may also contact the container retailer 400 by telephone, electronic mail, printed order forms, etc. in order to place the order.

After receiving the order information 350, the container retailer 400 then customizes the container 10 with the instructional and personal messages provided by or chosen by the purchaser 300. The container retailer 400 next places the specific bottles 30 of wine, spirits, gifts, and/or accessories into the compartments 20 and seals the compartments 20 with the panels 41-43. The container retailer 400 mails or delivers the sealed container 10 to the purchaser 300 or a recipient 500. If the container retailer 400 operates a retail store, then the container retailer 400 may notify the purchaser 300 or the recipient 500 that the container 10 is available for pickup.

Figure 21:
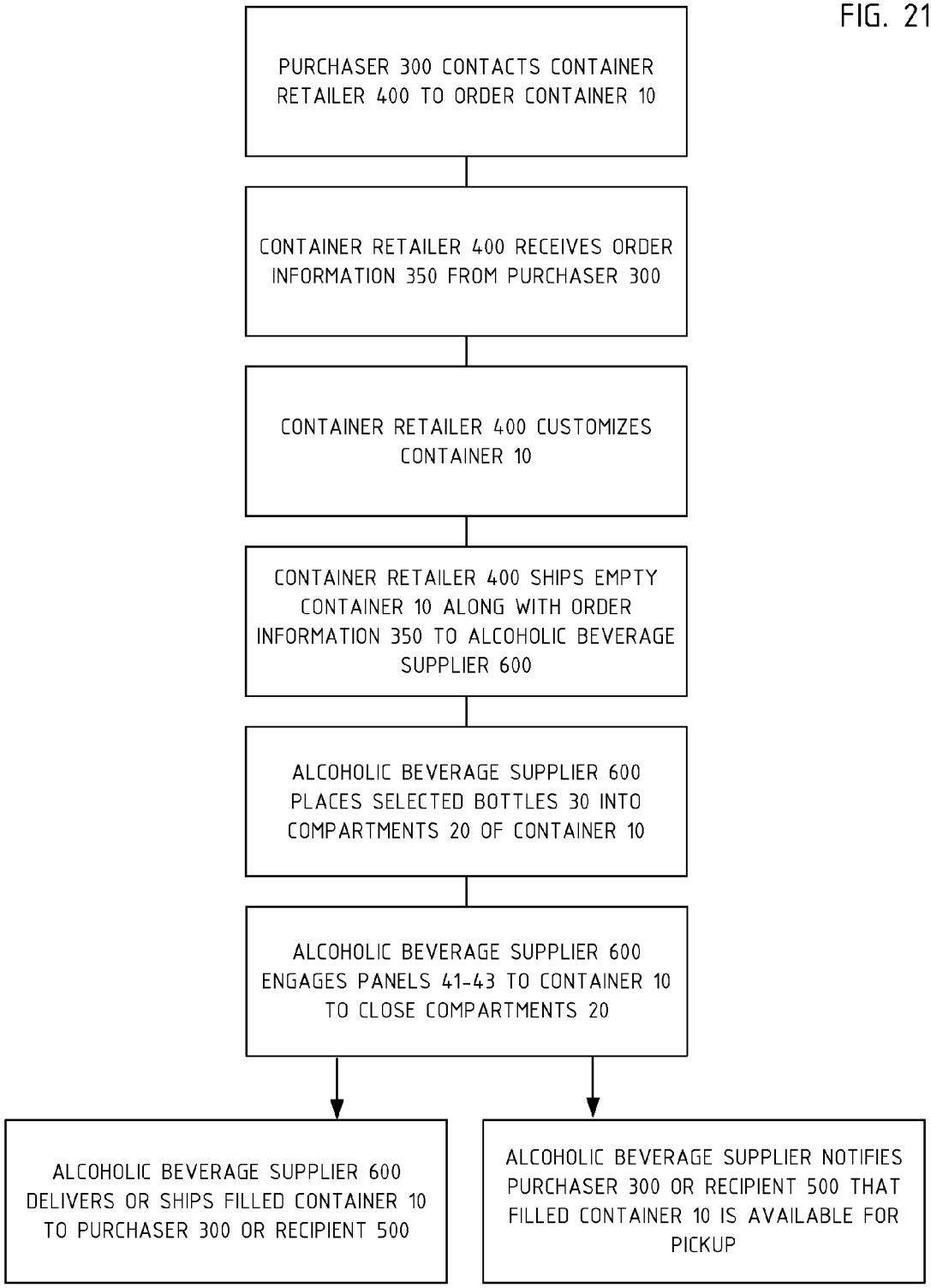
FIG. 21 shows a second method of providing the container to a purchaser or a recipient.

FIG. 21 shows a second method of providing the container 10 to the purchaser 300. The container retailer 400 receives the order information 330 from the purchaser 300 and then customizes the container 10. The container retailer 400 then ships the empty container 10 along with the order information 350 to an alcoholic beverage supplier 600, who places the selected bottles 30 of wine and/or spirits into the container 10. The alcoholic beverage supplier 600 then delivers the container 10 to the purchaser 300 or the recipient 500, or the alcoholic beverage supplier 600 notifies the purchaser 300 or the recipient 500 that the container 10 is available for pickup.

Figure 22:
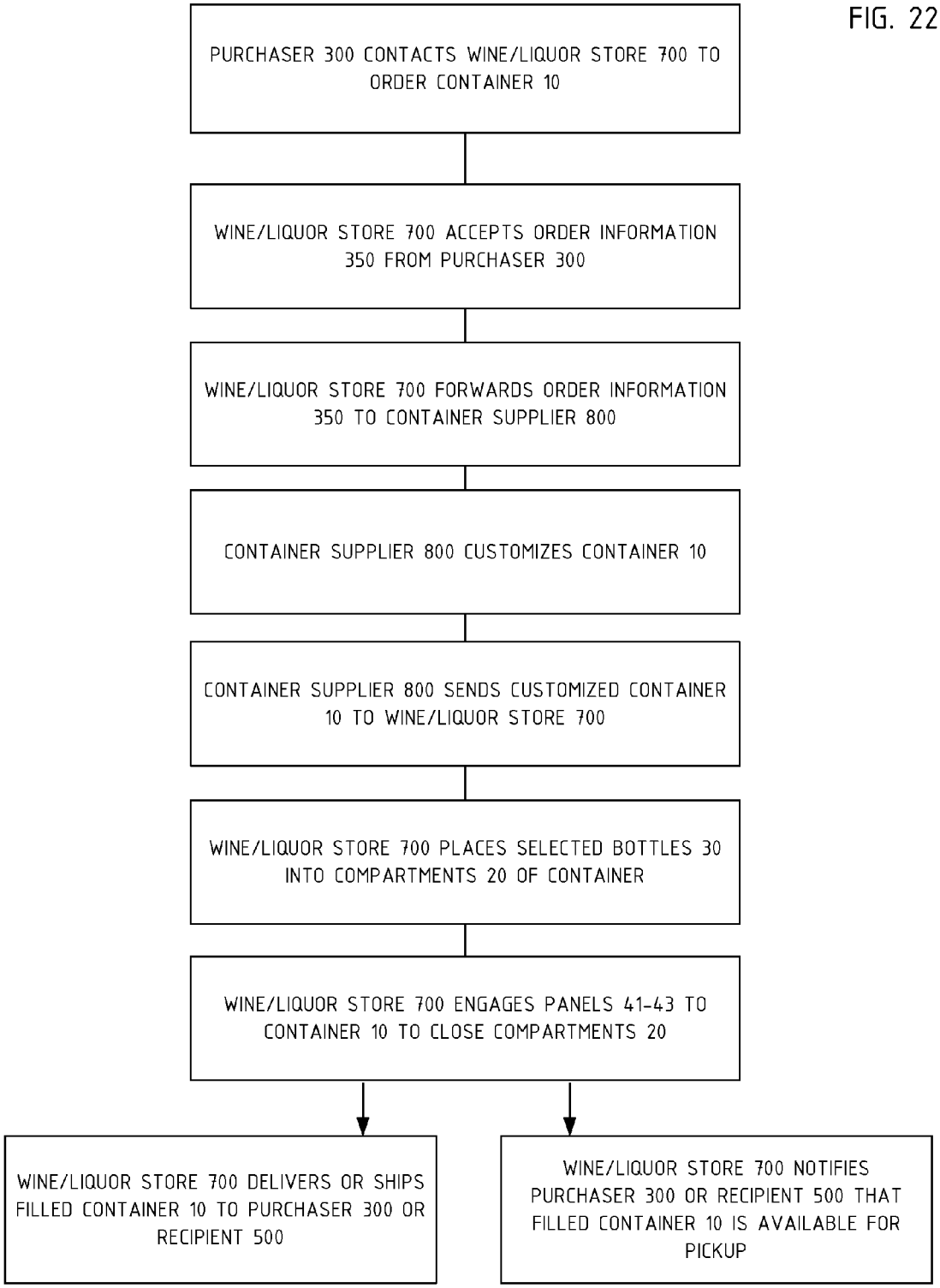
FIG. 22 shows a third method of providing the container to a purchaser or a recipient.

FIG. 22 shows a third method of providing the container 10 to a purchaser 300. The purchaser 300 contacts a wine/liquor store 700 to purchase the container 10. The wine/liquor 700 store accepts the order information 350 from the customer 300. The wine/liquor store 700 forwards the order information 350 to a container supplier 800. The container supplier 800 customizes the container 10 and returns the customized container 10 to the wine/liquor store 700. The wine/liquor store 700 places the selected bottles 30 of wine and/or spirits into the container 10, seals the container 10, and then delivers the container 10 to the purchaser 300 or the recipient 500, or the wine/liquor store 700 notifies the purchaser 300 or the recipient 500 that the container 10 is available for pickup.

Figure 23:
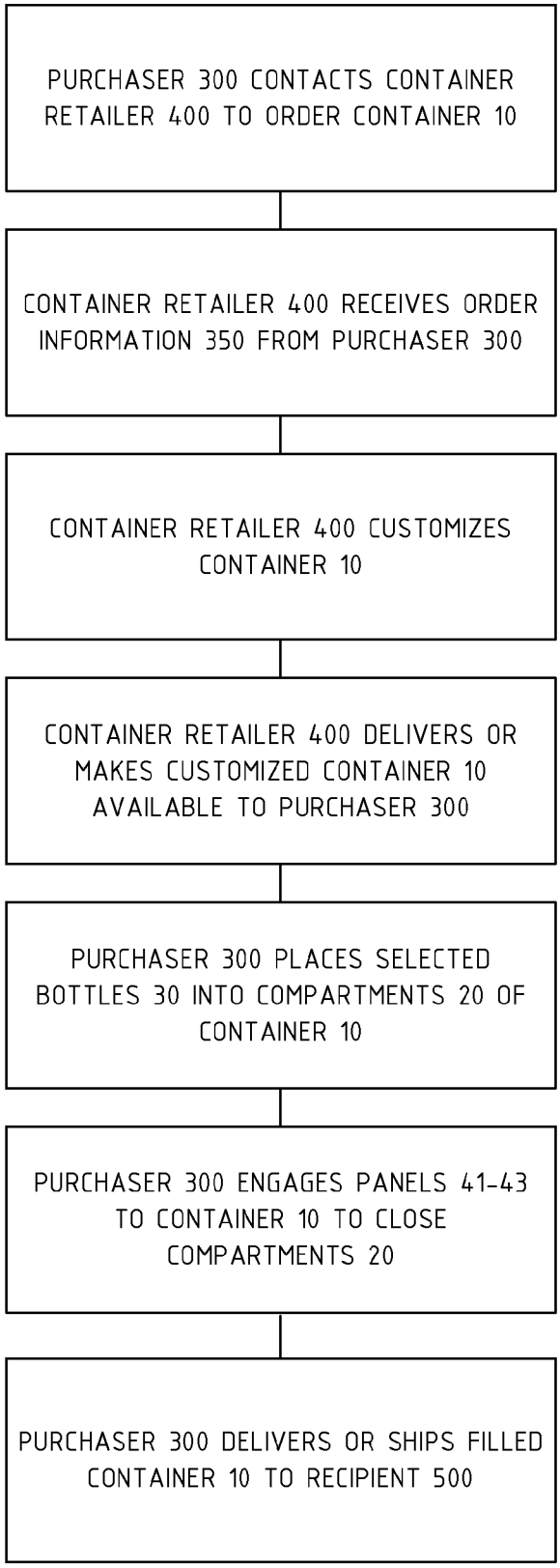
FIG. 23 shows a fourth method of providing the container to a purchaser or a recipient.

FIG. 23 shows a fourth method of providing the container 10 to a purchaser 300. The purchaser 300 contacts the container retailer 400 to purchase the container 10. The container retailer 400 accepts the order information 350 from the purchaser 300. The container retailer 400 customizes the container 10 and delivers or makes available the customized container 10 to the customer 300. The customer 300 places the selected bottles 30 of wine and/or spirits into the container 10, seals the container 10, and then delivers the container 10 to the recipient 500.

Those skilled in the art will appreciate that variations from the specific embodiments disclosed above are contemplated by the invention. The invention should not be restricted to the above embodiments, but should be measured by the following claims.

What is claimed:

1. A container holding beverage bottles, comprising:

a plurality of beverage bottles;

a plurality of compartments, wherein the compartments hold one of the plurality of beverage bottles;

a plurality of panels, wherein the panels removably engage to the container to close the compartments; and wherein the panels comprise a first side and a second side, wherein the first side of at least one of the panels includes a first message and the second side of the at least one panel includes a second message, wherein the first message of the panel is an instructional message identifying a date to remove the panel, wherein the first message and the second message are different, wherein the first message is visible when the panel is slideably engaged to the container to close the container, and wherein the second message is concealed when the panel is slideably engaged to the container to close the container.

2. The container according to claim 1, wherein the date is an anniversary.

3. The container according to claim 1, wherein the second message is a customized or personalized message.

4. The container according to claim 1, wherein each of the plurality of panels removably engage to the container such that either the first side or the second side faces an outside of the container when the panel is removably engaged to the container.

5. The container according to claim 1, wherein each of the plurality of panels are configured to removably engage to the container such that each panel closes one of the plurality of compartments, and the closing of the compartment conceals the contents of the compartment, and wherein the removal of one of the panels from a first compartment of the plurality of compartments does not reveal the contents of the other compartments.

6. The container according to claim 1, wherein the panels are removably engaged to the container to close the compartment, to conceal contents of the compartment, and to hold the beverage bottle in the compartment.

7. The container according to claim 1, wherein at least one of the compartments holds a bottle of wine or spirits.

8. The container according to claim 1, wherein each compartment holds a different bottle of wine or spirits.

9. The container according to claim 1, wherein one or more divider walls divide the container into the plurality of compartments, and the container comprises one to nine of the divider walls.

10. The container according to claim 1, wherein the container comprises two to ten compartments, and the container comprises two to ten panels.

11. The container according to claim 1, wherein the panels close the container in a reversible manner, wherein either the first side of the panel or second side of the panel is displayed.

12. The container according to claim 1, wherein the first message of the panel is an instructional message identifying a date to remove the panel, wherein the date is calculated from an anniversary of a wedding date.

13. The container according to claim 1, wherein the first side of a first panel of the plurality of panels comprises a first instructional message identifying a date to remove the first panel, wherein a first side of a second panel of the plurality of panels comprises a second instructional message identifying another date to remove the second panel.

14. The container according to claim 1, wherein the container is customized or personalized for a recipient, wherein a first side of a first panel of the plurality of panels comprises a first instructional message identifying a first date to remove the first panel, wherein a first side of a second panel of the plurality of panels comprises a second instructional message identifying a second date to remove the second panel, wherein the first and second dates are calculated by referring to the recipient's wedding anniversary date, birthday date, retirement date, graduation date, holiday date, or other date defined for the recipient.

15. The container according to claim 1, wherein a first side of a first panel of the plurality of panels comprises a first instructional message identifying a date to remove the first panel, wherein a second side of the first panel comprised a first personalized message, wherein a first side of a second panel of the plurality of panels comprises a second instructional message identifying another date to remove the second panel, and wherein a second side of the second panel comprises a second personalized message.

16. The container according to claim 1, wherein the panels are sealed by a sealer, and the sealer is a sticker, wax, tape, adhesive or combinations thereof.

17. The container according to claim 16, wherein the sealer contains a message.

18. The container according to claim 1, wherein the panel engages the container to display the second side of the panel.

19. A container to hold a gift or a beverage bottle, comprising:

a bottom wall joining a first side wall, a second side wall, a front wall, and a rear wall to form a container;

one or more divider walls extending from the first side wall to the second side wall to divide the container into two or more compartments, wherein the compartments are configured to hold a beverage bottle or a gift;

two or more panels, wherein the panels slideably engage with the container to close the compartments; and wherein the panels comprise a first side and a second side, wherein the first side includes a first message and the second side includes a second message, wherein the first message and the second message are different, wherein the second message is concealed when the panel is slideably engaged to the container to close the container and to display the first message, and wherein the first message is concealed when the panel is slideably engaged to the container to close the container and to display the second message.

20. A container to hold a gift or a beverage bottle, comprising:

a bottom wall joining a first side wall, a second side wall, a front wall, and a rear wall to form a container;

a first divider wall and a second divider wall to divide the container into three or more compartments;

the first divider wall includes a first divider wall groove and a second divider wall groove;

the second divider wall includes a first divider wall groove and a second divider wall groove;

the front wall includes a front wall groove;

the rear wall includes a rear wall groove;

a first panel slideably engages to the front wall groove and the first divider wall groove of the first divider wall;

a second panel slideably engages the second divider wall groove of the first divider wall and the first divider wall groove of the second divider wall;

a third panel slideably engages the second divider wall groove of the second divider wall and the rear wall groove;

wherein the first panel comprises a first side and a second side, wherein the first side includes a first message and the second side includes a second message, wherein the first message and the second message are different, wherein the second message is concealed when the first panel is slideably engaged to the container to close the container and to display the first message, and wherein the first message is concealed when the panel is slideably engaged to the container to close the container and to display the second message;

wherein the second panel comprises a first side and a second side, wherein the first side includes a third message and the second side includes a fourth message, wherein the third message and the fourth message are different, wherein the fourth message is concealed when the panel is slideably engaged to the container to close the container and to display the third message, and wherein the third message is concealed when the panel is slideably engaged to the container to close the container and to display the fourth message; and wherein the third panel comprises a first side and a second side, wherein the first side includes a fifth message and the second side includes a sixth message, wherein the fifth message and the six message are different, wherein the sixth message is concealed when the panel is slideably engaged to the container to close the container and to display the fifth message, and wherein the fifth message is concealed when the panel is slideably engaged to the container to close the container and to display the sixth message.

21. A container holding a plurality of beverage bottles, comprising:

a plurality of beverage bottles;

a bottom wall joining a first side wall, a second side wall, a front wall, and a rear wall to form a container;

one or more divider walls extending from the first side wall to the second side wall to divide the container into a plurality of compartments, wherein the compartments hold one of the plurality of beverage bottles;

a first panel that slideably engages with the container to close a first compartment of the plurality of compartments; wherein the first panel comprises a first side and a second side; wherein the first side includes a first message that is displayed when the first panel is slideably engaged to the container to close the container and to conceal the beverage bottle in the first compartment; wherein the first message of the first panel is an instructional message identifying a date to remove the panel; and wherein the date is calculated from an anniversary of a wedding date; and, a second panel that slideably engages with the container to close a second compartment of the plurality of compartments; wherein the second panel comprise a third side and a fourth side; wherein the third side includes a second message that is displayed when the second panel is slideably engaged to the container to close the container and to conceal the beverage bottle in the second compartment; wherein the second message of the second panel is an instructional message identifying a second date to remove the second panel; wherein the second date is calculated from the anniversary of the wedding date; and wherein the first message and the second message are different.

* * * * *